United States Patent [19]

Roggenburg et al.

[11] Patent Number: 4,823,990

[45] Date of Patent: Apr. 25, 1989

[54] DISPENSING DEVICE

[75] Inventors: Stanley L. Roggenburg, Staten Island, N.Y.; Robert H. Laauwe, Franklin Lakes; John L. Polite, Saddle River, both of N.J.; Michael Tully, Staten Island, N.Y.

[73] Assignee: Essex Chemical Corporation, Clifton, N.J.

[21] Appl. No.: 134,703

[22] Filed: Dec. 18, 1987

[51] Int. Cl.[4] ..... B65D 37/00

[52] U.S. Cl. ..... 222/207; 222/212; 222/341; 222/377; 222/379; 222/447; 222/496

[58] Field of Search ..... 222/105, 181, 207, 209, 222/213, 206, 215, 339, 341, 379, 447, 381, 494, 496, 490, 96, 495, 424.5, 425, 377, 212

[56] References Cited

U.S. PATENT DOCUMENTS

| | | | |
|---|---|---|---|
| 2,093,942 | 9/1937 | Stuff | 222/181 |
| 3,828,985 | 8/1974 | Schindler | 222/207 |
| 3,871,558 | 3/1975 | Gournelle | 222/181 |
| 3,885,709 | 5/1975 | Levy | 222/377 X |
| 3,994,393 | 11/1976 | Nilson | 222/494 X |
| 4,226,342 | 10/1980 | Laauwe | 222/494 |
| 4,238,056 | 12/1980 | Tucker et al. | 222/181 |
| 4,478,356 | 10/1984 | Roggenburg, Jr. et al. | 222/207 X |
| 4,506,809 | 3/1985 | Corsette | 222/494 X |
| 4,570,827 | 2/1986 | Roggenburg et al. | 222/181 X |
| 4,634,022 | 1/1987 | O'Halloran et al. | 222/181 X |

FOREIGN PATENT DOCUMENTS

| | | | |
|---|---|---|---|
| 2098958 | 12/1982 | United Kingdom | 222/207 |

*Primary Examiner*—Joseph J. Rolla
*Assistant Examiner*—Gregory L. Huson
*Attorney, Agent, or Firm*—Kenyon & Kenyon

[57] ABSTRACT

A dispensing device for a bag container a liquid, made of flexible material and forming upper and lower walls through which holes are formed for receiving the device, has a tubular lower part with a top flange which is sealed to the inside of the lower wall and depends through the hole in the lower wall. A tubular upper part has a top flange sealed to the inside of the upper wall and depends through the hole in that wall and is telescoped inside the lower part so as to move up and down in the lower part. The top of the upper part forms a piston such as a collapsible dome extending upwardly through the hole in the upper wall and exposed on the outside of the upper wall and therefore exposed on the outside of the bag. The lower part has a lower end having a self-closing valve and has at least one side port normally open to a space between the flanges and therefore between the bag walls. The lower part has one or more ports normally open to that space and through which liquid contained by the bag can flow into the interior of the device. The upper and lower parts are elastically or spring biased apart and when the piston is pressed the upper part moves down into the lower part until stopped by interengaging of the two flanges, forcing open a self-closing valve in the bottom end of the lower part, so that the liquid in the bag is dispensed.

7 Claims, 7 Drawing Sheets

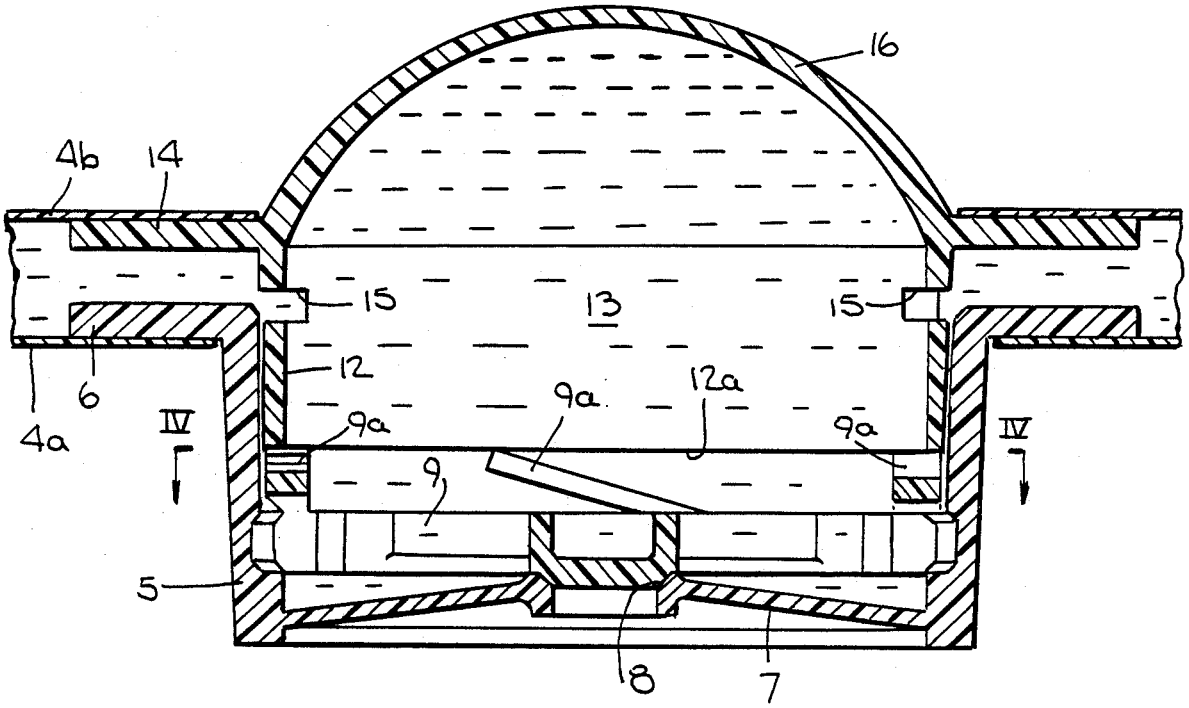
Fig. 3.
Fig. 4.
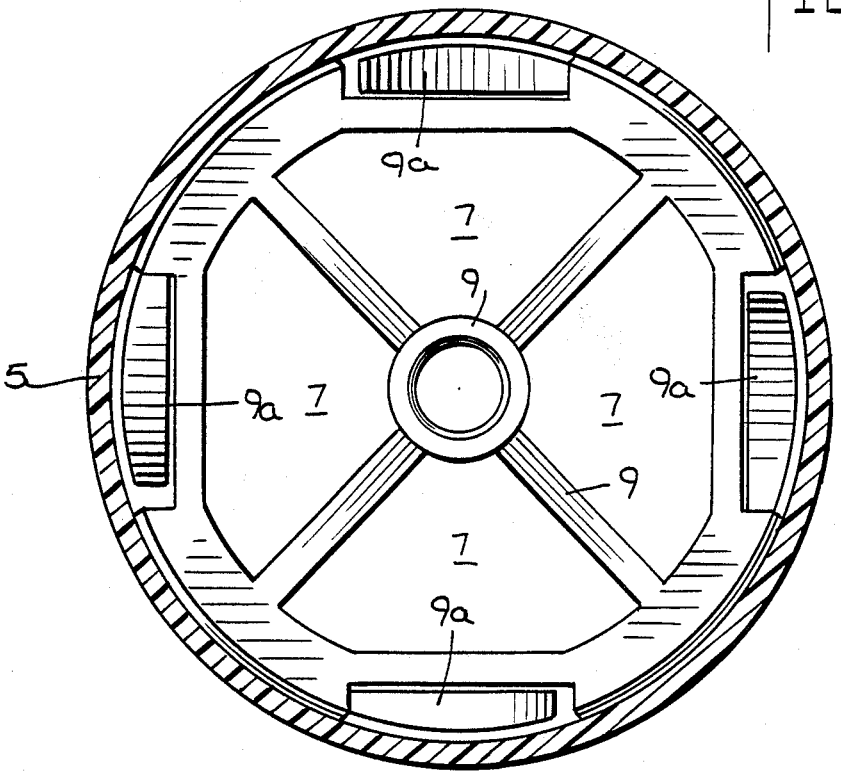

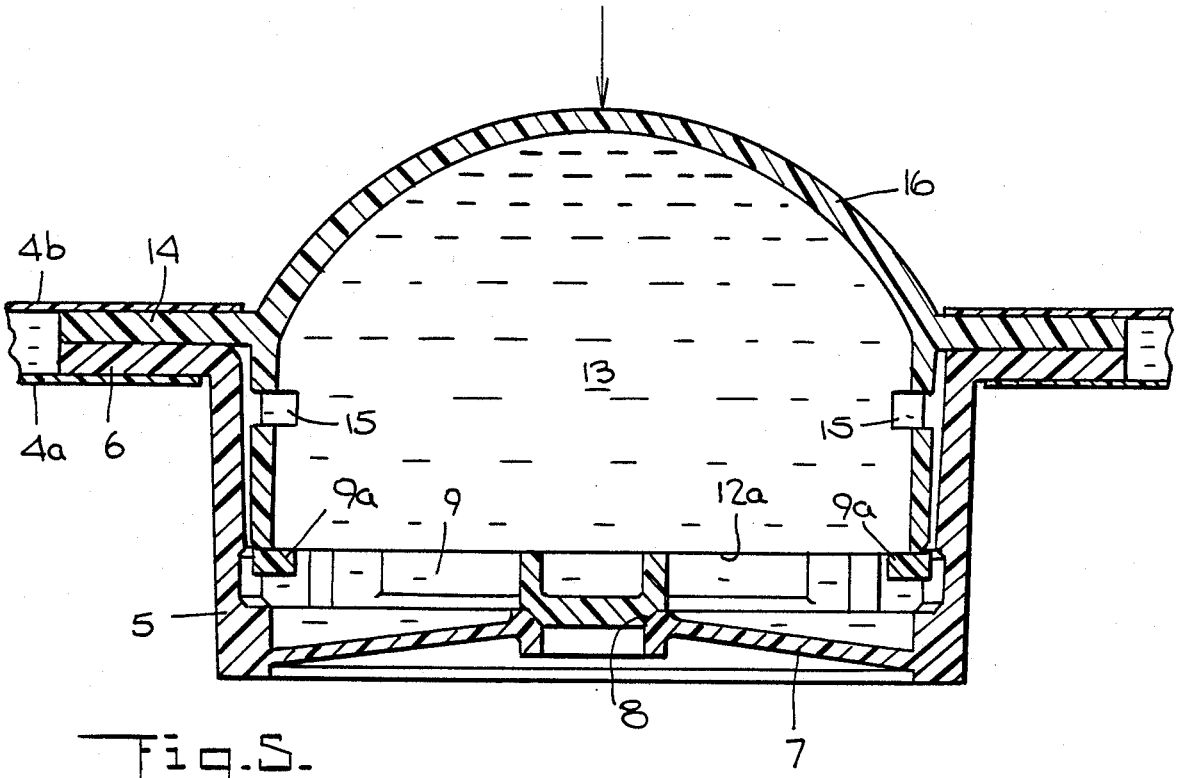
Fig.5.
Fig.6.
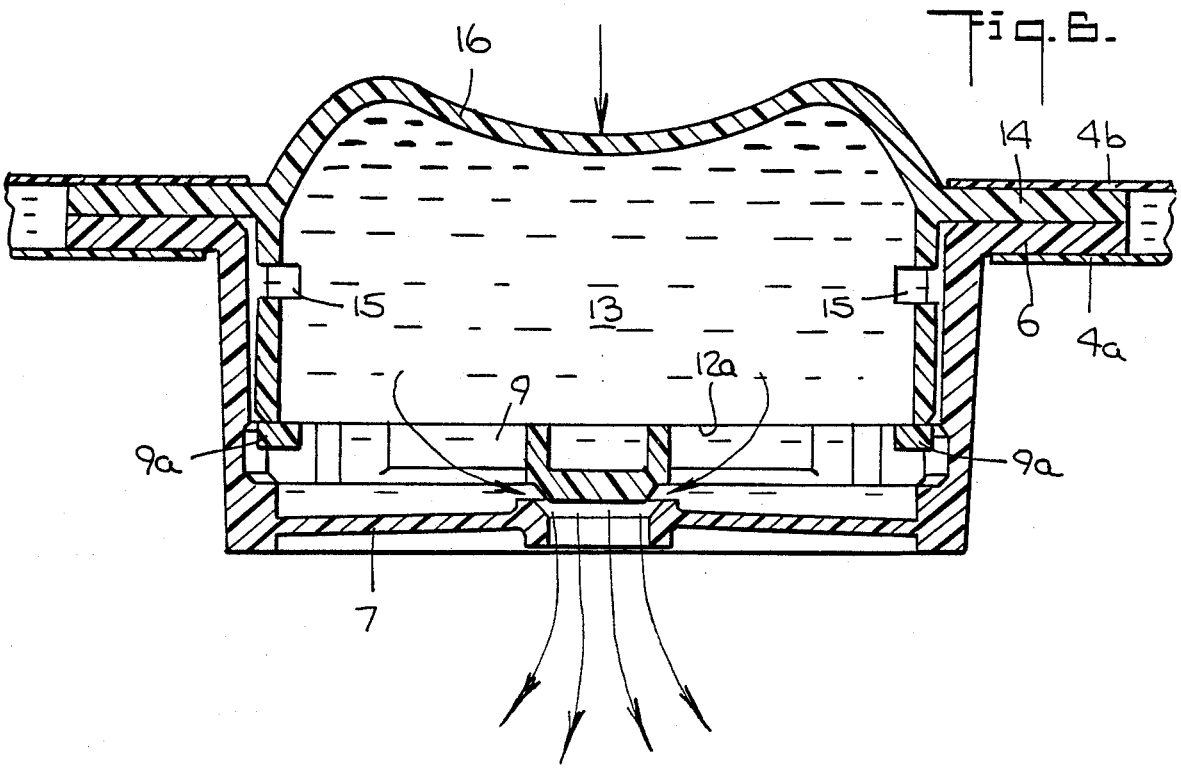

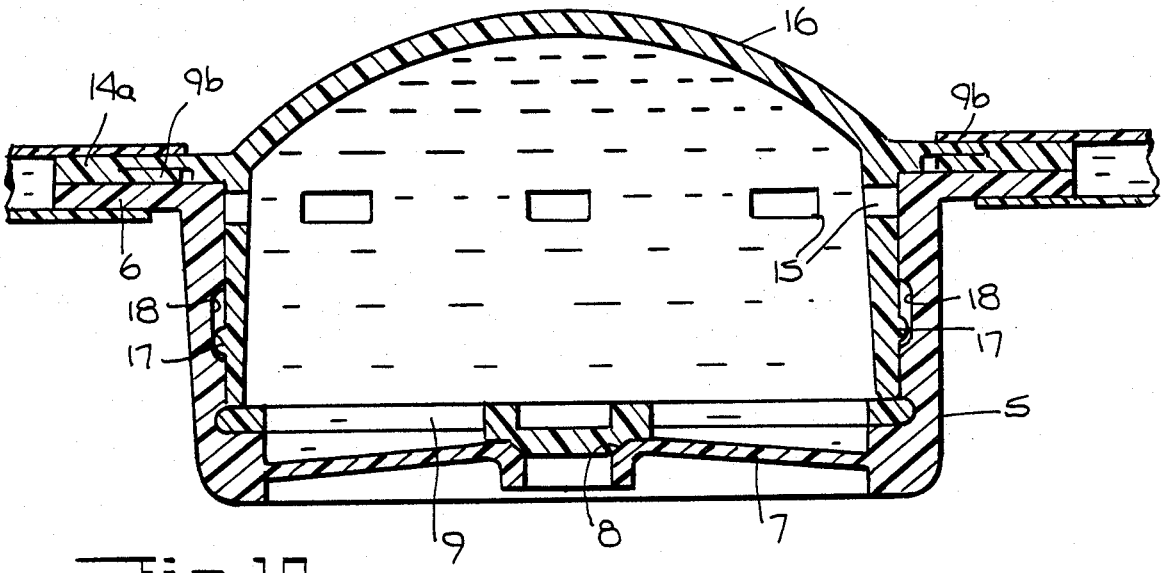
Fig. 10.
Fig. 11.
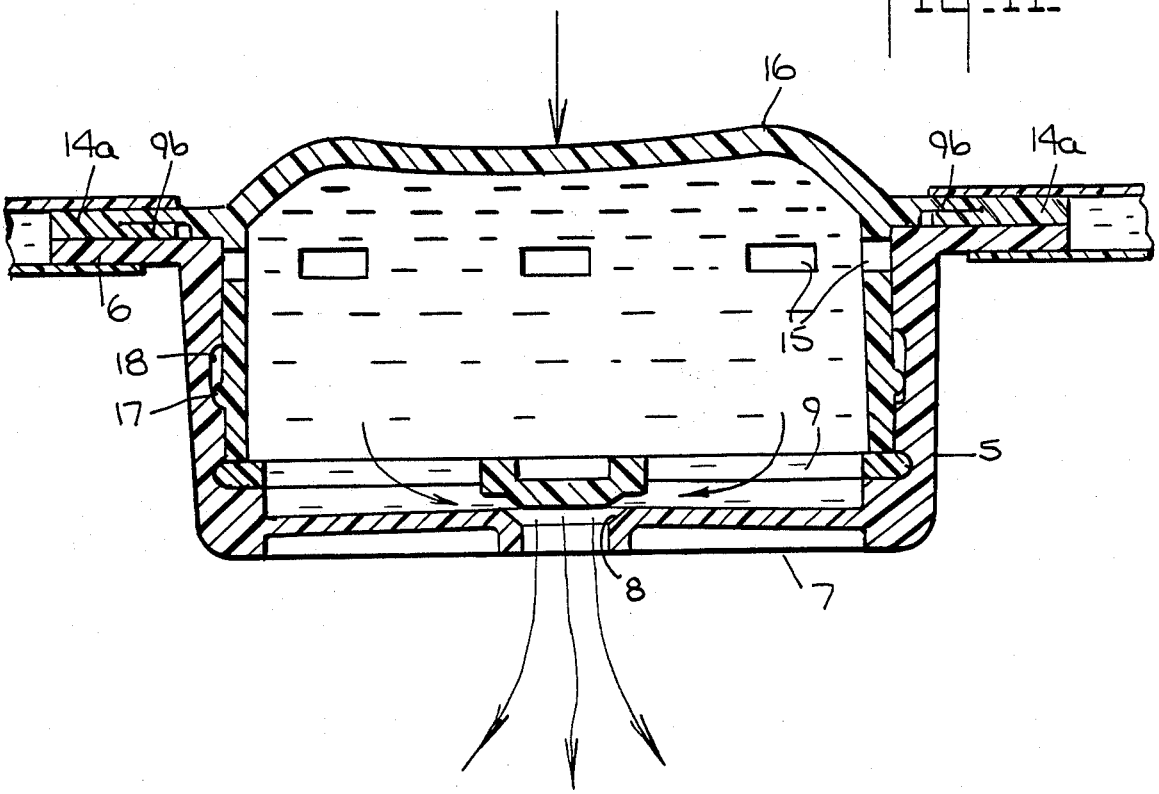

DISPENSING DEVICE

This invention relates to dispensing devices for liquids such as liquid hand soap, and of the type comprising a flexible plastic bag containing the liquid and having a lower end portion formed by mutually opposite front and back walls.

The back wall has a hole in which a self-closing metering valve is sealed. This valve comprises a tubular part which extends through the hole in the bag wall, with its outer end normally closed by a self-closing valve. The upper end of this part is open to the inside of the bag but closed by an elastically deflective dome having a hole through which liquid in the bag can enter and fill the space between the inside of the dome and the self-closing valve. The dome is completely on the inside of the bag walls.

By finger pressure on the other bag wall it presses against and seals the hole in the dome and with continued pressure collapses the dome so that it acts as a piston to increase the pressure of the liquid on the self-closing valve, the latter consequently opening and dispensing the liquid. After the dome has been collapsed completely the finger pressure on the other bag wall is released, the self-closing valve closes and with the hole in the dome now open the space between the inside of the dome and the self-closing valve refills with the liquid.

The bag is normally hung by its top against the back wall of a cabinet having a forwardly projecting shelf, the bottom or lower portion of the bag being folded forwardly so as to form upper and lower walls, and supported on this shelf with a portion of its valve extending downwardly through the hole in the shelf. Each finger pressure on the upper bag wall causes the liquid to be dispensed in the form of shots each metered in volume by the volume of the space beneath the dome and self-closing valve.

An object of the present invention is to provide a device of the type described with the actuating dome positioned completely outside of the bag through the upper bag wall, and free from the hole in the top of the dome.

Another object is to provide such a device with the elastically deflective dome replaced by a rigid piston having a flat bottom reducing the possibility for the entrapment of any substantial volume of air under the bottom. An example of a prior art device having the dome provided with the hole and positioned completely on the inside of the bag where it can be actuated only through deflecting the bag wall, is provided by the Roggenburg and Laauwe U.S. Pat. No. 4,478,356.

Briefly summarized, applicant's new device requires both the upper and lower walls of the forwardly folded lower bag portion, to be formed with holes which mutually register. The device has a lower tubular part depending through the hole in the lower bag wall and an outward flange on its top which is sealed to the inside of the lower wall, and an upper tubular part having a top forming a piston which is accesible upwardly through the hole in the upper bag wall and outside of the upper bag wall This upper part has an outer flange which is sealed to the inside of the upper bag wall and from which depends a tubular part which is slidingly telescoped inside of the lower part of the device. The two bag walls keep the lower and upper parts from completely separating. The lower part has its outer or bottom end closed by a self-closing valve.

A spring arrangement elastically biases the lower and upper parts of the device normally separated so that there is a space between the opposing flanges of the parts, and the upper part has a circumferencial series of ports through which liquid can flow to the inside of the device through the space between the two flanges, to between the dome and self-closing valve of the device.

With this new device the actuator, dome or piston, is on the outside of the bag walls where it is directly accessible. The dome or piston is free from the prior art hole requiring closure by the finger of the person actuating the device.

To operate the new device the dome or piston is pressed downwardly until the upper part telescopes down into the lower part so that the flanges of the two parts intercontact and seal off the inside of the device from the inside of the bag containing the liquid. Continued pressure on the dome or piston now causes pressure on the liquid trapped inside the device, so that the self-closing valve is forced open and dispensing of the liquid occurs. The amount of liquid dispensed for each operation of the device is determined by the volume of the interior of the device between the dome or piston and the self-closing valve.

The accompanying drawings illustrate examples of the new device, the various figures being as follows:

FIG. 1 is a perspective view of the type of cabinet previously referred to.

FIG. 3 is a vertical section of the new device when using the dome.

FIG. 4 is a horizontal cross section taken on the line IV—IV in FIG. 3.

FIG. 5 is the same as FIG. 3 but shows the two parts of the device pressed together so that the flanges of the two parts seal together.

FIG. 6 is like FIG. 5 but shows the actual dispensing operation.

FIG. 10 is like FIG. 8 but shows the initial stage of operation.

FIG. 11 is like FIG. 9 but shows the actual dispensing operation.

Figure 2:
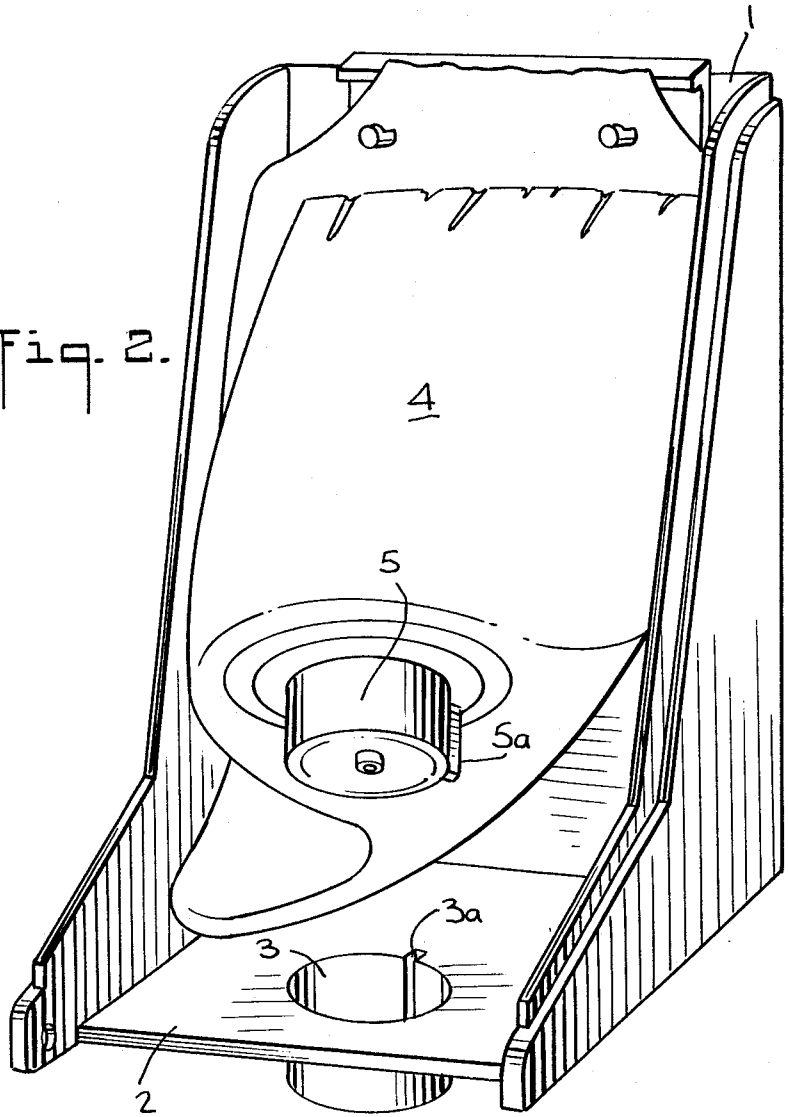
FIG. 2 is a perspective view with the front of the cabinet removed and showing the bag of liquid with the downwardly extending portion of the new device about to be inserted in the hole through the forwardly projecting shelf of the cabinet.
Figure 1:
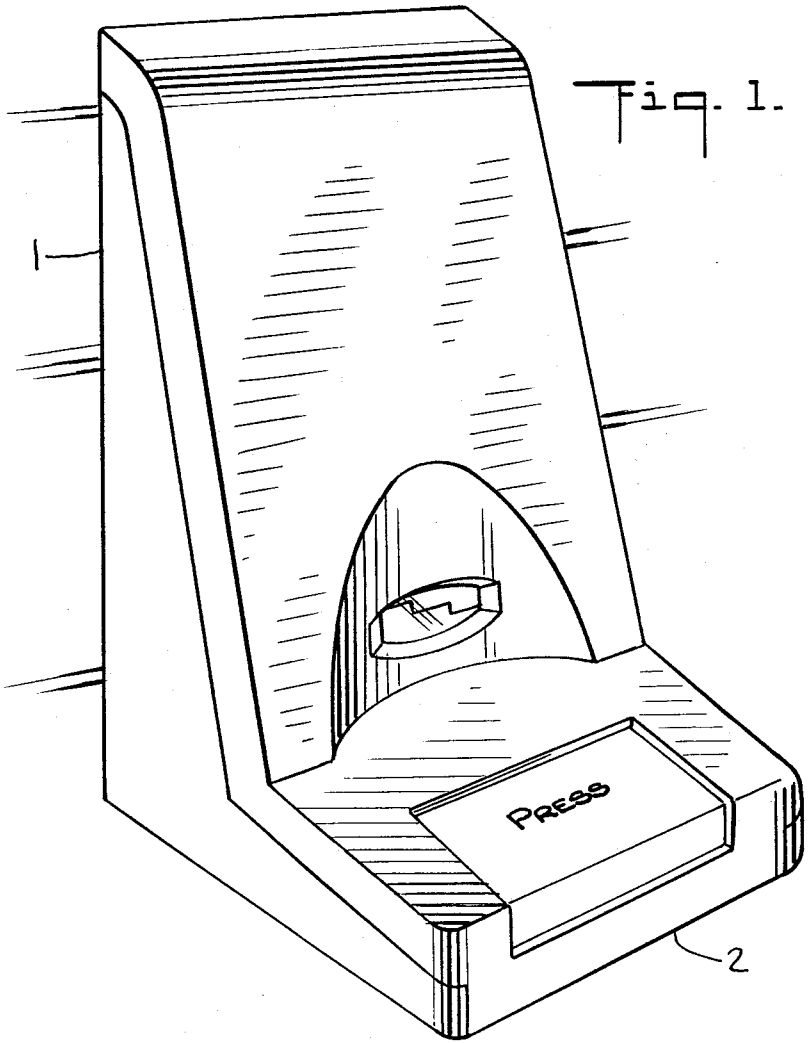
Figure 7:
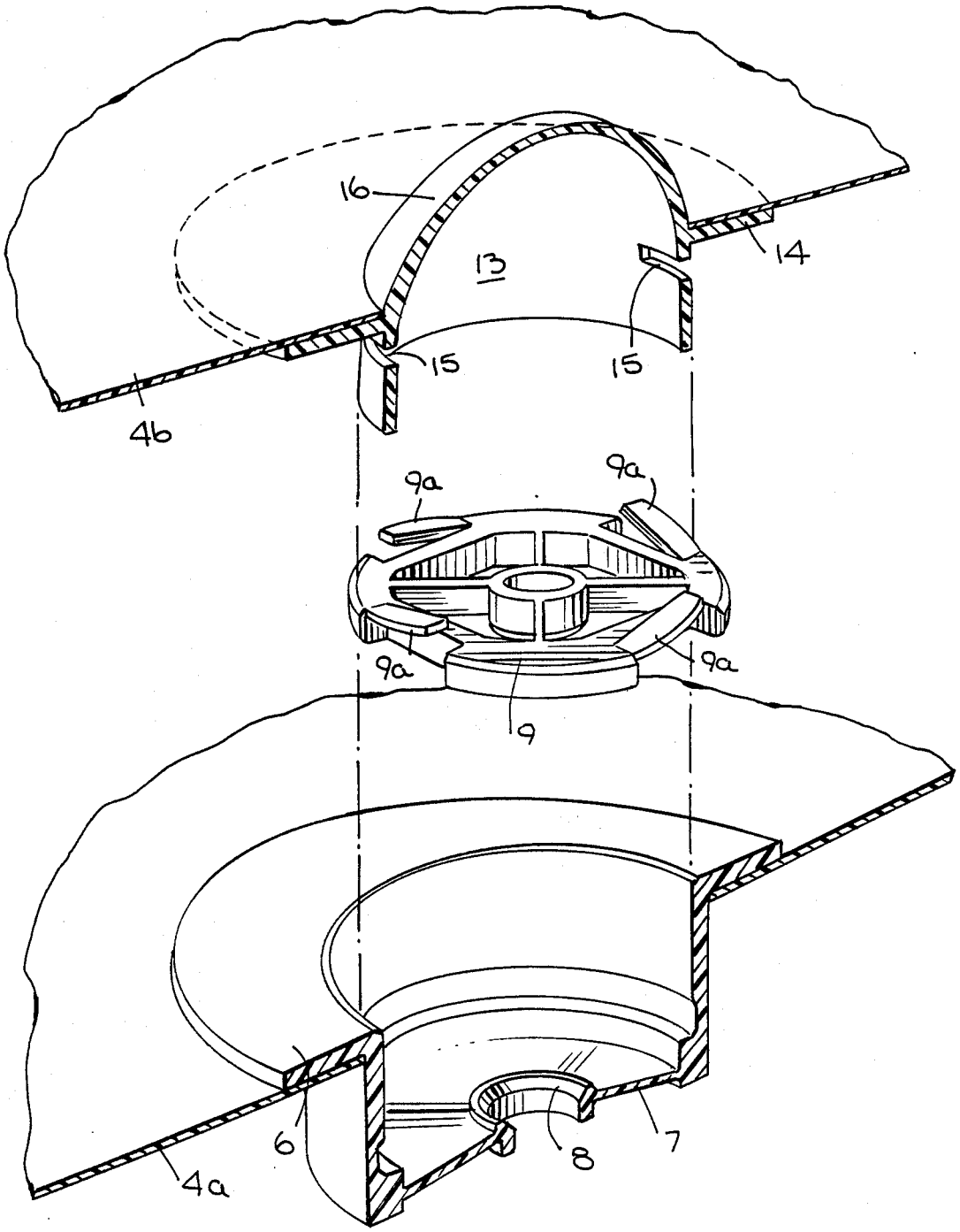
FIG. 7 is an exploded view of the new device.

The cabinet shown by FIGS. 1 and 2 has a back wall 1 which is vertical and ordinarily fastened to a vertical wall, and a forwardly projecting shelf 2 having the hole 3. In FIG. 2 the cabinet cover is removed, and the bag 4 formed by flexible front and back walls and having its lower portion folded forwardly, is about to be laid on the shelf 2 with the bag's dispensing device having its downwardly lower part about to be inserted in the hole 3. The bag is made from very flexible plastic sheets side seemed together hermetically and containing the liquid to be dispensed such as liquid soap.

The lower tubular part 5 of the device is formed with a rib **5*a* and the hole 3 is formed with a groove 3*a***, insuring that only appropriate bags are used with the cabinet.

The lower part 5 of the device is preferably cylindrical and has an inner end with an external flange 6 for sealing to the inside of the lower bag wall 4*a*. This tubular body of the lower part 5 extends downwardly for insertion in the hole 3 of the cabinet and its bottom end supports an elastically deflective diaphragm 7 having a discharge opening forming a valve seat 8. A valve head 9 is stationary and supported above the valve seat 8 by a spider 9 having a periphery snapped in a groove on the inside of the part 5. The valve seat 8 is normally pressed against the valve head 9 by the elasticity of the diaphragm 7, liquid under pressure on the top of this diaphragm causing it to move downwardly and open the valve seat 8 from the valve head 9.

The device includes an upper part formed by a tubular or cylindrical body 12 having an upper flange 14 which is sealed to the inside of the upper wall of the bags forwardly folded bottom portion. The tubular body 12 of the upper part 13 is telescoped inside of the tubular body of the lower part and can slide up and down in the lower part.

The spider 9 is formed with an annular series of upward acting springs 9*a* which bear against the bottom periphery of the upper part 13 and keep it elastically biased upwardly. The two parts of the valve cannot completely separate because of the restraint offered by the bag walls 4*a* and 4*b*. The tubular body 12 of the upper part has a circumferential series of ports 15 which registered with the space between the separated flanges 6 and 14, and liquid in the bag can flow through these ports to the inside of the upper and lower parts of the device.

The upper part from its flange 14 upwardly has the elastically deflective dome 16 which is free from the top hole of the prior art devices. For operation, the dome 16 is initially pressed downwardly, the entire upper part moving downwardly so that the flanges 6 and 14 press together and fluid-tightly trap the liquid that flowed into the device initially. After only a short downward movement the bottom 12*a* of the upper part's body 13 completely collapses the springs 9*a* and solidly engages a periphery of the spider 9, as shown by FIG. 5. Continued pressure on the dome causes it to collapse and pressurize the liquid trapped in the device so that the liquid presses the diaphragm 7 of the self-closing valve downwardly, so that discharge is effected as shown by FIG. 6.

Figure 8:
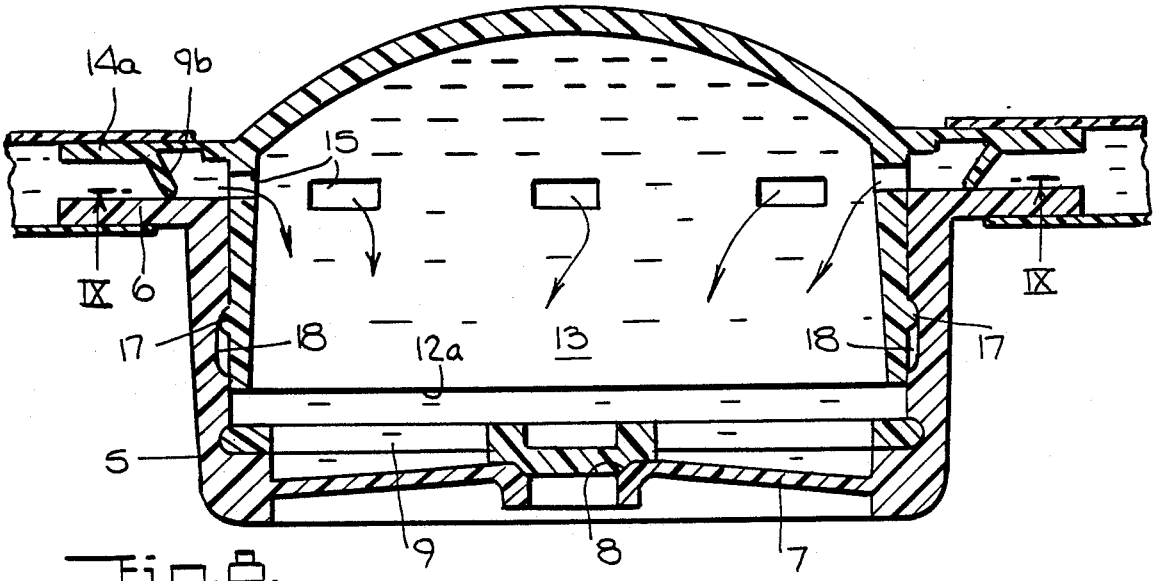
FIG. 8 is like FIG. 3 but shows a modification of the device.
Figure 9:
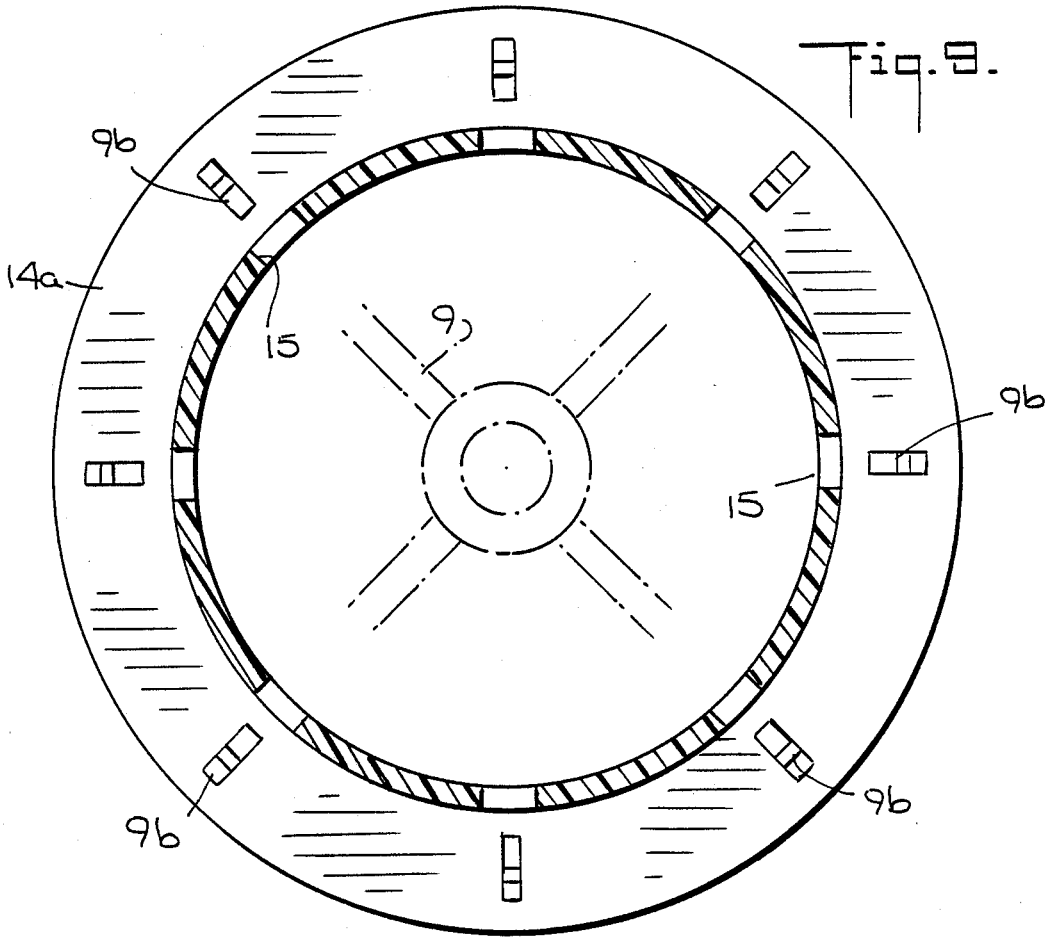
FIG. 9 is a cross section taken on the line IX—IX in FIG. 8.

The modification shown by FIGS. 8 and 9 is the same in principal but differs in construction details. In this case the springs 9*a* are replaced by a circumferential series of spring fingers 9*b* formed by the upper part's flange 14*a* and which press against the lower part's flange 6. In this way the flanges are biased apart as before. Positively limiting the upward movement of the upper part from the lower part, the lower part has one or more projections or beads 17 which ride in vertical grooves 18 and limit vertical movement. In this way the parts are held against separation whether or not the device is installed with its two parts sealed to the two bag walls.

Figure 12:
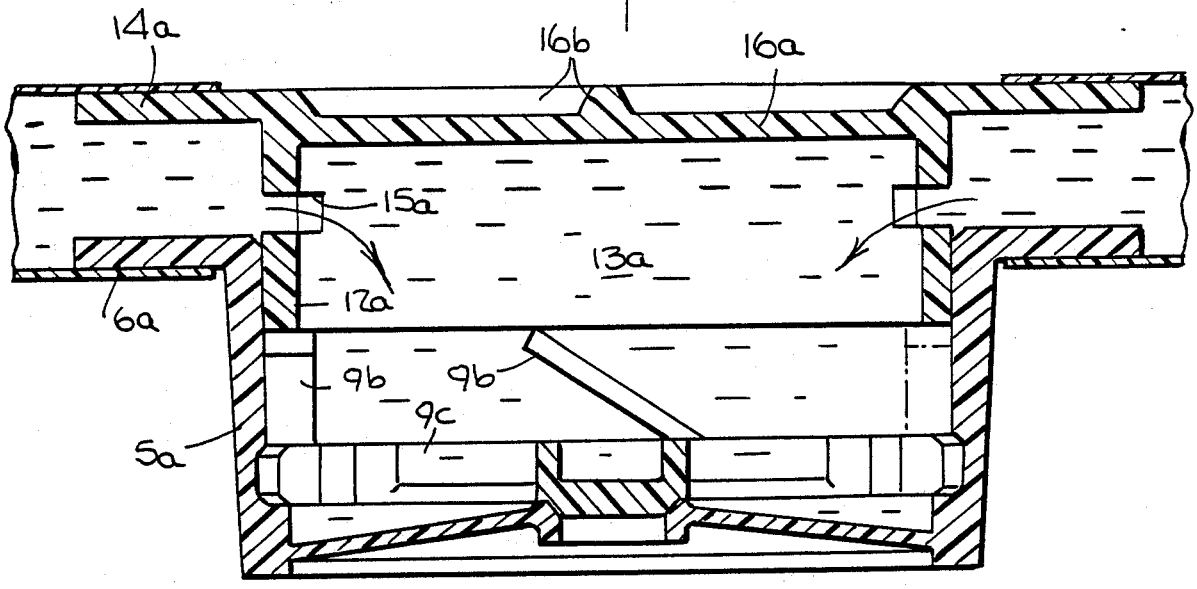
FIG. 12 is like FIG. 3 but shows the device when using a rigid piston.
Figure 13:
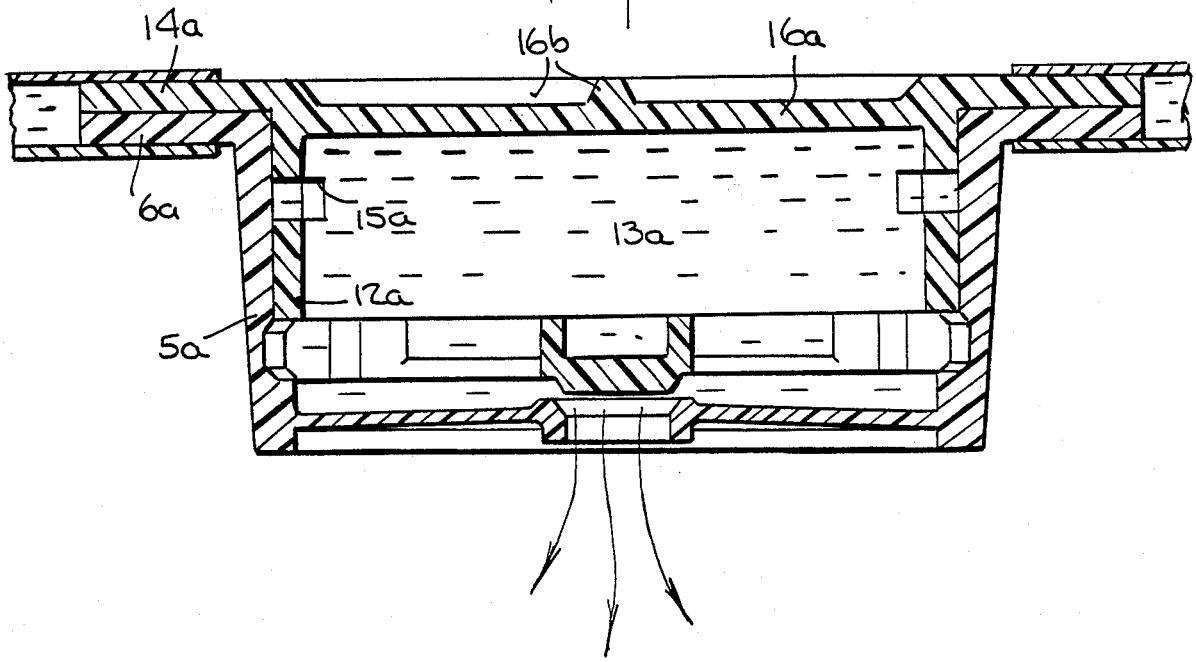
FIG. 13 is like FIG. 12 but shows the dispensing operation.

The example shown by FIGS. 12 and 13 uses the rigid type of piston.

In this case the tubular part 5*a* of the lower part and the tubular part 12*a* of the upper part are lengthened and the springs 9*b* extended more upwardly so that the upper part can move through a much longer distance than before relative to the lower part. The ports 15*a* are positioned so as to be closed by the tubular port 5*a* so that liquid in the devise is locked against reverse flow soon after initial downward displacement of the upper part. This locking occurs whether or not the flanges 6*a* and 14*a* interengage.

Instead of the dome, the top of the upper tubular part is closed by a solid rigid wall 16*a*. If the upper part is plastic this wall may be integral with the tubular part and rigidfied by ribs 16*b*. This flat top can be on the same level or close thereto as the balance of the upper part but exposed to the outside of the upper bag wall.

When operated the entire upper part moves downwardly with its rigid top acting as a rigid piston. The upper part should be proportioned so that is does not bottom on the ring 9*c* until an adequate liquid discharge is obtained.

The advantage is that the flat rigid top does not provide space below its bottom for the collection of air which might interfere with the desired operation of the device.

We claim:

1. A dispensing device for a bag made of flexible material and forming upper and lower walls through which mutually registered holes are formed for receiving the device, the device comprising a tubular lower part having a top forming an outward flange which is sealed to the inside of the lower wall with the lower part depending through the hole in the lower wall, and a tubular upper part having a top forming an outward flange which is sealed to the inside of the upper wall and depending through the hole in the upper wall and telescoped inside the lower part and movable up and down therein, the top of the upper part forming a piston closing the top and accessible on the outside of the upper wall, spring means for elastically biasing the parts apart from each other so that normally there is a space between the flanges, the lower part having a lower end and a self-closing valve normally closing the lower end of the lower part, the upper part having at least one side port normally open to said space so that liquid in the bag can flow into the parts, movement of the upper part into the lower part moving the flanges into intercontact and sealing the space between the flanges.

2. The device of claim 1 in which said piston is in the form of an elastically collapsible dome closing the top of said upper part and extending upwardly through the hole in the upper wall and exposed, on the outside of the upper wall.

3. The device of claim 1 in which said piston is in the form of a rigid wall substantially on the same level as the top of the upper tubular part and which is rigidly connected to the top of the upper part.

4. The device of claim 1 in which said upper and lower parts each comprise a plastic molding.

5. The device of claim 4 in which a spider has a ring positioned between said parts and said spring means comprises an annular series of leaf springs formed by the ring of the spider and which bear against the bottom periphery of the upper part.

6. The device of claim 4 in which said spring means comprises an annular series of springs formed by the flange of one of said parts and which bear against the flange of the other said parts.

7. A dispensing device of a bag made of flexible material and forming upper and lower walls through which mutually registered holes are formed for receiving the device, the device comprising a tubular lower part having a top forming an outward flange which is sealed to the inside of the lower wall with the lower part depending through the hole in the lower walls, and a tubular upper part having a top forming an outward flange which is sealed to the inside of the upper wall and depending through the hole in the upper wall and telescoped inside the lower part and movable up and down therein, the top of the upper part forming a piston closing the top and accessible on the outside of the upper wall, spring means for elastically biasing the parts apart from each other so that normally there is a space between the flanges, the lower part having a lower end and a self-closing valve normally closing the lower end of the lower part, the upper part having at least one side port normally open to said space so that liquid in the bag can flow into the parts, movement of the upper part into the lower part moving the flanges into intercontact and sealing the space between the flanges; a spider having a ring positioned between said parts, said spring means comprising an annular series of leaf springs formed by the ring of the spider and which bear against the bottom periphery of the upper part, said spider forming a valve head and the bottom of said lower part being closed by an elastically deflective diaphragm having a hole forming a valve seat normally pressed against and closed by the valve head.

* * * * *